US005577861A

United States Patent [19]

Oberth et al.

[11] Patent Number: 5,577,861

[45] Date of Patent: Nov. 26, 1996

[54] CRASH ATTENUATOR WITH VEHICLE-DEFLECTING MEMBER

[75] Inventors: Michael H. Oberth, Folsom; John V. Machado, Antelope, both of Calif.

[73] Assignee: Energy Absorption Systems, Inc., Chicago, Ill.

[21] Appl. No.: 562,907

[22] Filed: Nov. 27, 1995

Related U.S. Application Data

[62] Division of Ser. No. 339,137, Nov. 14, 1994, Pat. No. 5,494,371.

[51] Int. Cl.[6] ..... E01F 15/00

[52] U.S. Cl. ..... 404/6; 256/13.1

[58] Field of Search ..... 404/6, 7, 9; 256/1, 256/13.1

[56] References Cited

U.S. PATENT DOCUMENTS

| | | | |
|---|---|---|---|
| Re. 29,544 | 2/1978 | Fitch . | |
| 3,944,187 | 3/1976 | Walker . | |
| 4,101,115 | 7/1978 | Meinzer . | |
| 4,289,419 | 9/1981 | Young et al. . | |
| 4,399,980 | 8/1983 | van Schie . | |
| 4,498,803 | 2/1985 | Quittner | 404/6 |
| 4,500,225 | 2/1985 | Quittner . | |
| 4,681,302 | 7/1987 | Thompson . | |
| 4,711,481 | 12/1987 | Krage et al. . | |
| 4,770,420 | 9/1988 | Gottwald et al. . | |
| 4,806,044 | 2/1989 | Duckett . | |
| 4,828,425 | 5/1989 | Duckett . | |
| 4,934,661 | 6/1990 | Denman . | |
| 5,011,326 | 4/1991 | Carney, III . | |
| 5,156,485 | 10/1992 | Ivey et al. . | |
| 5,192,157 | 3/1993 | Laturner . | |

FOREIGN PATENT DOCUMENTS

| | | |
|---|---|---|
| 452893 | 10/1991 | European Pat. Off. . |
| 4038538A1 | 6/1992 | Germany . |

*Primary Examiner*—James A. Lisehora
*Attorney, Agent, or Firm*—Brinks Hofer Gilson & Lione

[57] ABSTRACT

A crash attenuator for an exposed end of a concrete highway barrier includes a light weight array of sheet metal energy-absorbing elements interposed between diaphragms. The crash attenuator is cantilevered from one end of the barrier by a mounting arrangement that includes mounting tubes on the barrier and the attenuator that can be quickly secured together by removable pins. The energy-absorbing elements define a single row of tubular columns in forward portions of the crash attenuator and two rows of tubular columns in rearward portions of the crash attenuator. Vehicle deflecting members extend between the barrier and the crash attenuator and can fold against the barrier for storage.

2 Claims, 9 Drawing Sheets

Fig. 7
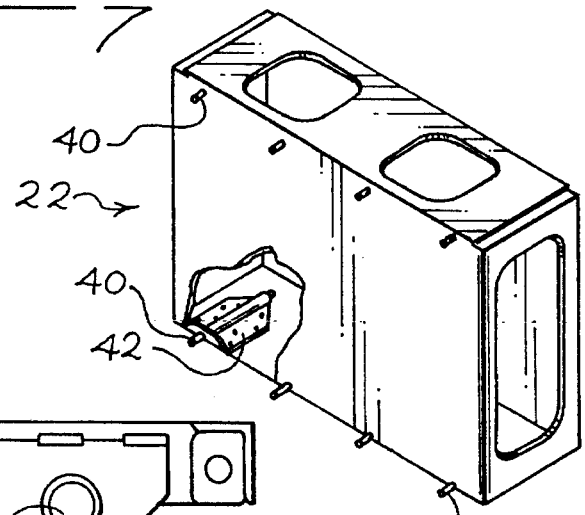
Fig. 10
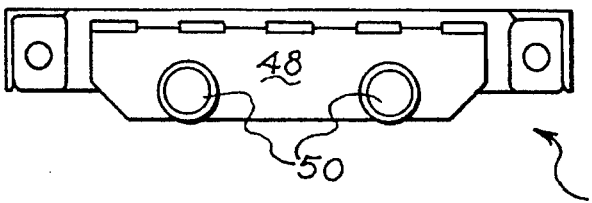
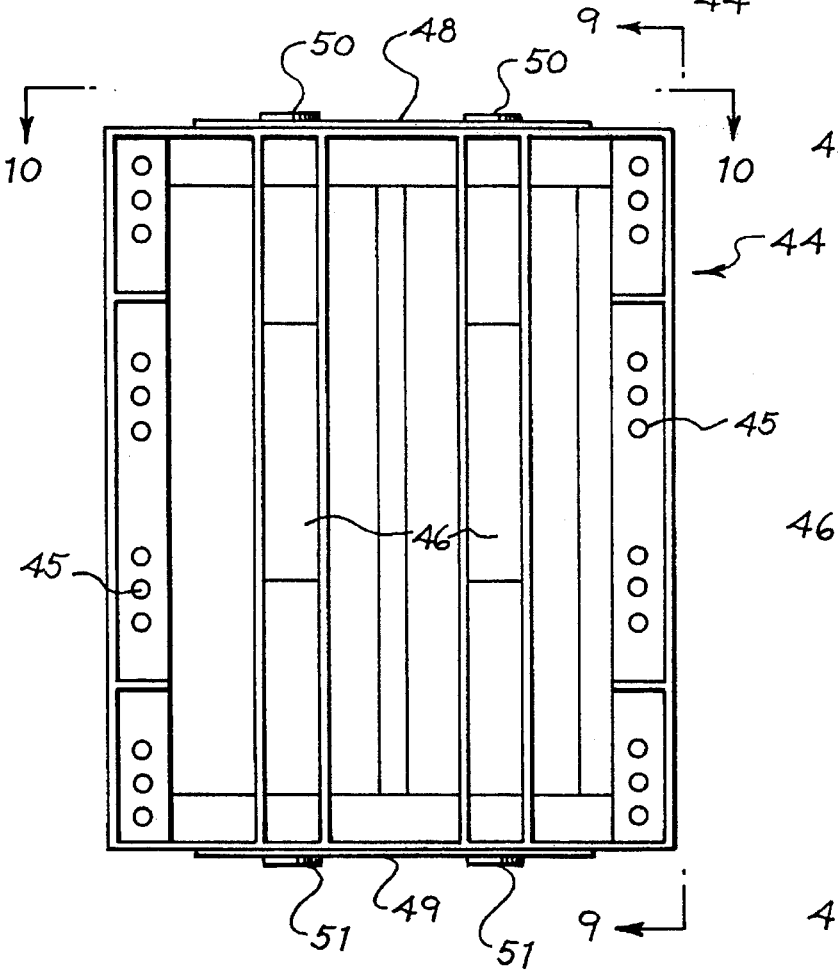
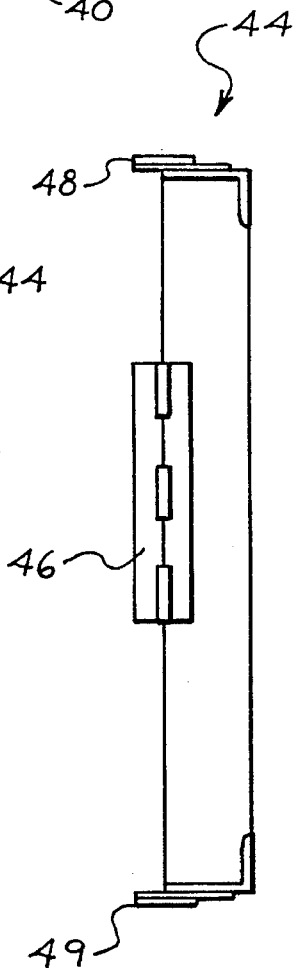
Fig. 8
Fig. 9

Fig. 17
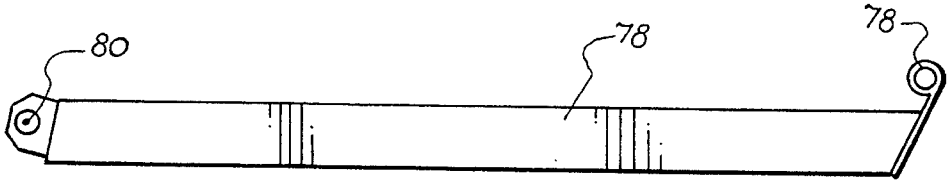
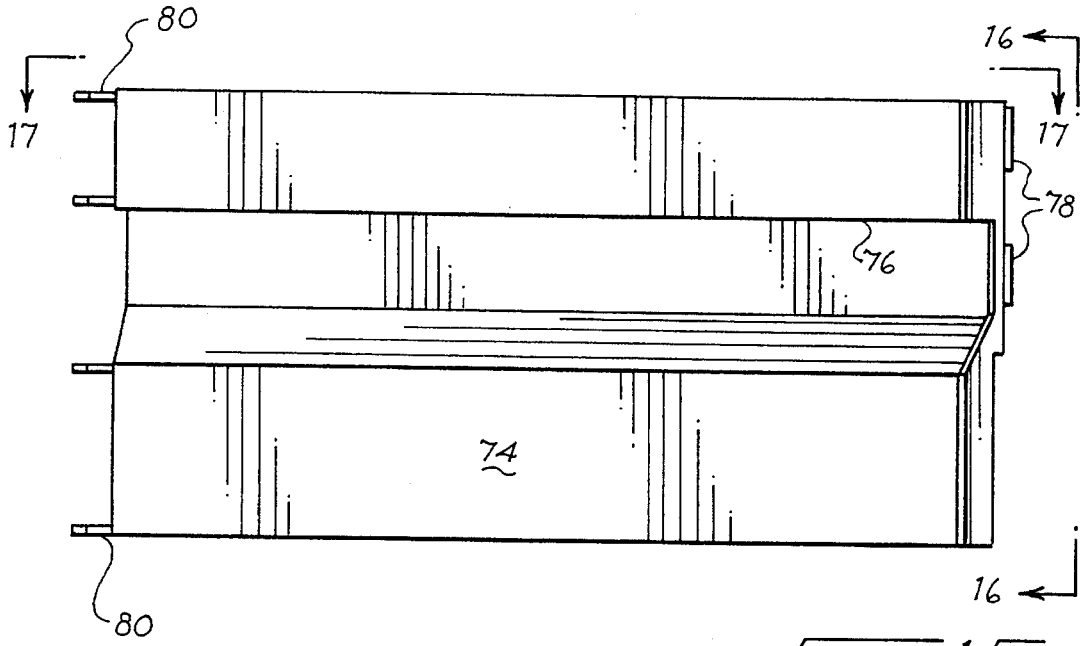
Fig. 15
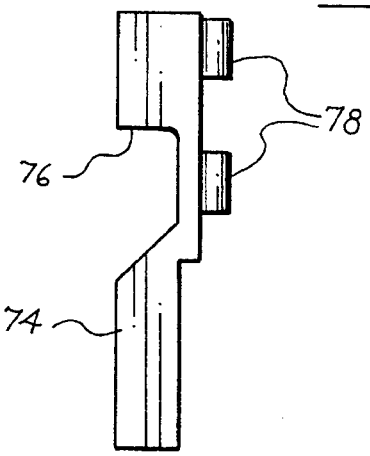
Fig. 16

CRASH ATTENUATOR WITH VEHICLE-DEFLECTING MEMBER

This application is a division of application Ser. No. 08/339,137, filed Nov. 14, 1994 now U.S. Pat. No. 5,494, 371.

BACKGROUND OF THE INVENTION

This invention relates to a crash attenuator suitable for mounting to the end of a barrier, such as a roadside highway median barrier.

Exposed, unprotected ends of a median barrier, such as a concrete median barrier, present a hazard to an oncoming vehicle. In the past, several approaches have been used to protect motorists in oncoming vehicles from such barrier ends.

Sacrificial inertial crash attenuators have been used, which include a frangible container containing a dispersible material such as sand. See for example, U.S. Pat. No. Re. 29,544 (Fitch), 4,289,419 (Young) and 4,934,661 (Denman). This approach is well recognized for its effectiveness. The relatively large mass of the dispersible material makes it difficult for a small number of personnel to install or replace a damaged inertial crash attenuator quickly without lifting equipment.

Another approach is disclosed in U.S. Pat. No. 3,944,187 (Walker). With this approach an array of energy-absorbing elements is mounted within a framework that is designed to collapse upon impact. The framework is guided by ground anchors of various types prior to and during a collision. The preparation of the site, including the installation of such ground anchors, makes it difficult to install such crash barriers quickly with limited equipment and personnel.

A third approach is disclosed in U.S. Pat. No. 5,192,157 (Laturner), in which an energy-absorbing device is cantilevered on the end of a barrier. This approach reduces or eliminates the need for ground anchors and the like and thereby speeds installation.

U.S. Pat. No. 4,711,481 (Krage) discloses a lightweight impact attenuating device having folded, sheet metal energy absorbing elements mounted between parallel diaphragms. The Krage patent suggests that the disclosed energy absorbing elements can be used in the system of the Walker patent.

Further improvements are possible, and it would be of great advantage to the industry if a light-weight crash attenuator were available that could be mounted on and removed from the end of a barrier quickly and efficiently with a small number of installing personnel and little additional equipment.

SUMMARY OF THE INVENTION

The crash attenuator described below includes a collapsible energy-absorbing portion which is rigidly secured to a mounting portion. According to a first aspect of this invention, the mounting portion comprises at least two first mounting tubes rigidly secured thereto. The mounting tubes are positioned and configured to receive removable pins that rigidly and releasably secure the attenuator to the end of the barrier. With this approach, removable pins allow a small number of installing personnel to quickly install or remove the crash attenuator to or from the barrier, and ground anchors may be substantially eliminated, if desired.

According to a second aspect of this invention, the crash attenuator itself is made of light-weight construction so as further to facilitate installation and removal. In the preferred embodiment described below, the energy-absorbing portion comprises an array of bays separated by diaphragms and an array of energy-absorbing elements, each secured between an adjacent pair of diaphragms. Each of the energy absorbing elements comprises a tubular column extending between the adjacent pair of diaphragms transverse to the diaphragms. The bays comprise at least one forward bay and at least one rearward bay. The energy absorbing elements in the forward bay are arranged with the tubular columns forming a single row. The energy-absorbing elements in the rearward bay are arranged with the tubular columns forming at least two rows, one alongside the other to substantially increase the number of tubular columns in the rearward bay as compared to the forward bay. This approach provides the crash attenuator with a relatively easily deformed forward section that does not subject an impacting vehicle to an excessively high initial deceleration. This advantage is obtained with a rearward bay arranged as described to provide substantially increased decelerating forces.

According to a third aspect of this invention, at least one vehicle deflecting member is hinged to the barrier to pivot between an extended position, in which the vehicle deflecting member is secured between the barrier and the crash attenuator to provide a transition between the profile defined by the barrier and the crash attenuator, and a retracted position, in which the vehicle deflecting member is stored alongside the barrier when the crash attenuator is removed from the barrier. Because the vehicle deflecting member is hinged to the barrier, the vehicle deflecting member can quickly be installed on the crash attenuator and stored, further facilitating quick installation and removal.

These and other aspects of the invention will better be understood by reference to the following detailed description, taken conjunction with the accompanying drawings.

BRIEF DESCRIPTION OF THE DRAWINGS

FIG. 7 is a rear perspective view of an attachment structure included in the crash attenuator of FIG. 2.

FIG. 8 is a rear elevational view of the mounting portion included in the crash attenuator of FIG. 1.

FIG. 9 is a side view taken along line 9—9 of FIG. 8.

FIG. 10 is a top view taken along line 10—10 of FIG. 8.

FIG. 15 is a side elevational view of a vehicle deflecting panel.

FIG. 16 is a front view taken along line 16—16 of FIG. 15.

FIG. 17 is a top view taken along line 17—17 of FIG. 15.

DETAILED DESCRIPTION OF THE PRESENTLY PREFERRED EMBODIMENTS

Figure 1:
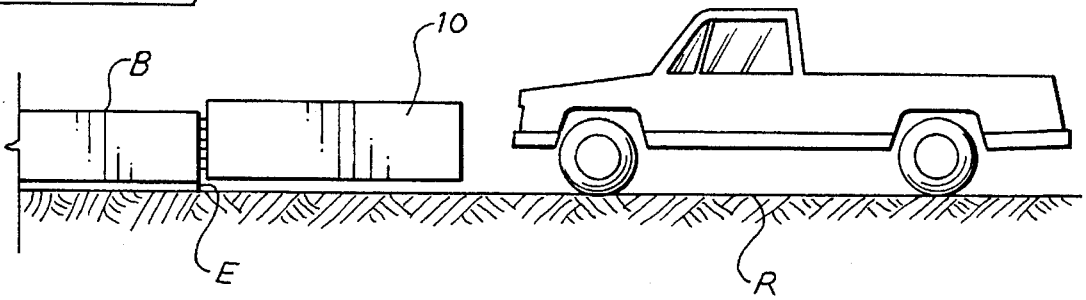
FIG. 1 is a side elevational view of a preferred embodiment of the crash attenuator of this invention mounted to a concrete barrier alongside a roadway.

Turning now to the drawings, FIG. 1 shows a side view of a barrier B having an exposed end E alongside a roadway R. A crash attenuator 10 is rigidly secured to the end E of the barrier B so as to be cantilevered above and parallel to the roadway R. The only point of attachment or support for the crash attenuator 10 is at the barrier B, as described below.

Figure 2:
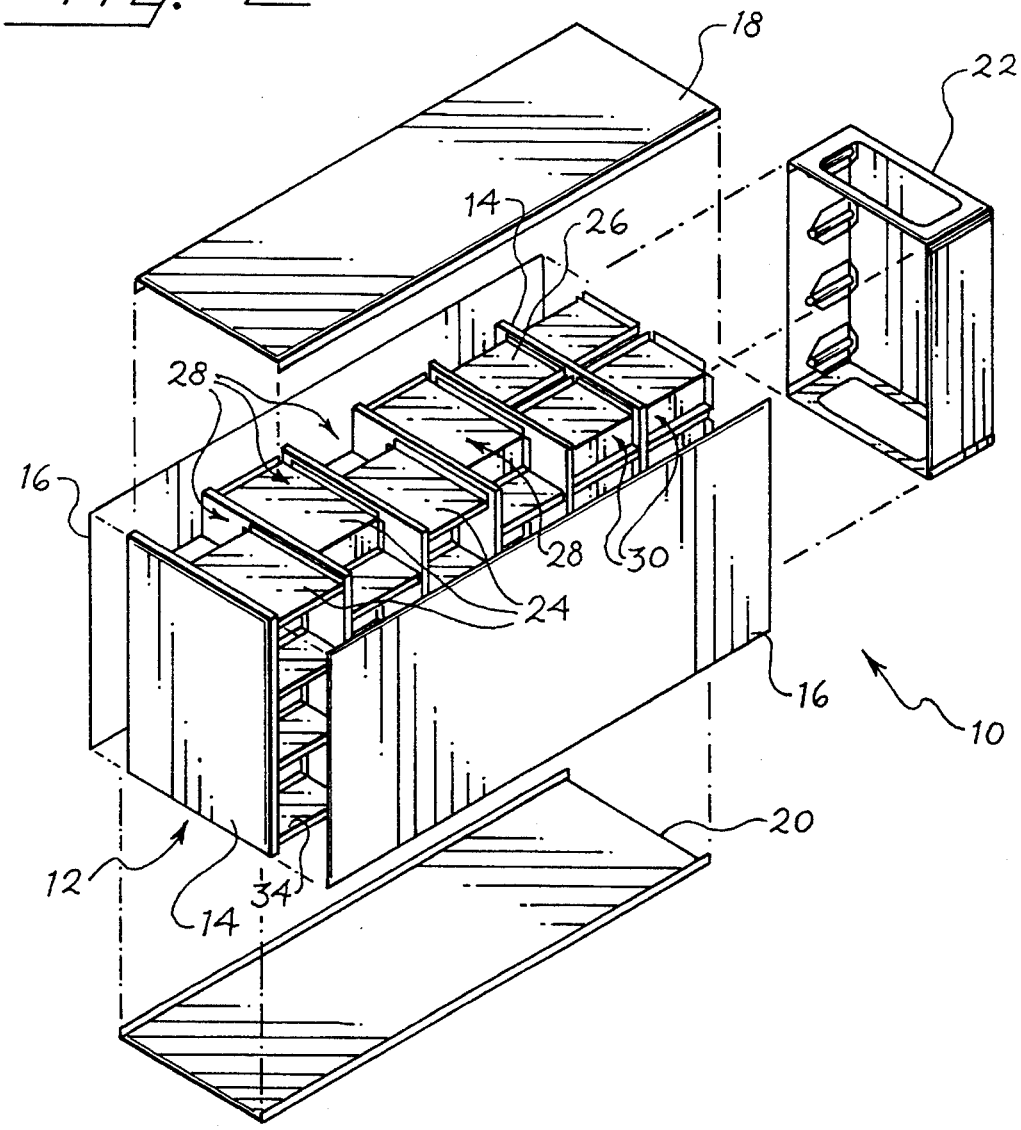
FIG. 2 is an exploded perspective view of the energy absorbing portion of the crash attenuator of FIG. 1.

FIGS. 2–10 provide detailed views of the crash attenuator 10. As shown in FIG. 2, the crash attenuator 10 includes a collapsible energy-absorbing portion 12. The energy-absorbing portion 12 is formed primarily of a suitable sheet metal such as aluminum. The energy-absorbing portion 12 includes an array of spaced, parallel diaphragms 14 surrounded by a enclosure including side panels 16 and top and bottom panels 18, 20. The forward end of the crash attenuator 10 may be provided with a deformable nose piece (not shown) if desired, and suitable safety markings such as high contrast chevrons can be applied.

As best shown in FIG. 2, energy-absorbing elements 24, 26 are interposed between respective ones of the diaphragms 14. The region between adjacent diaphragms can be referred to as a bay. The energy-absorbing elements 24 are positioned between the diaphragms 14 in the forward bays 28, and the energy-absorbing elements 26 are positioned between the diaphragms 14 in the rearward bays 30.

Figure 3:
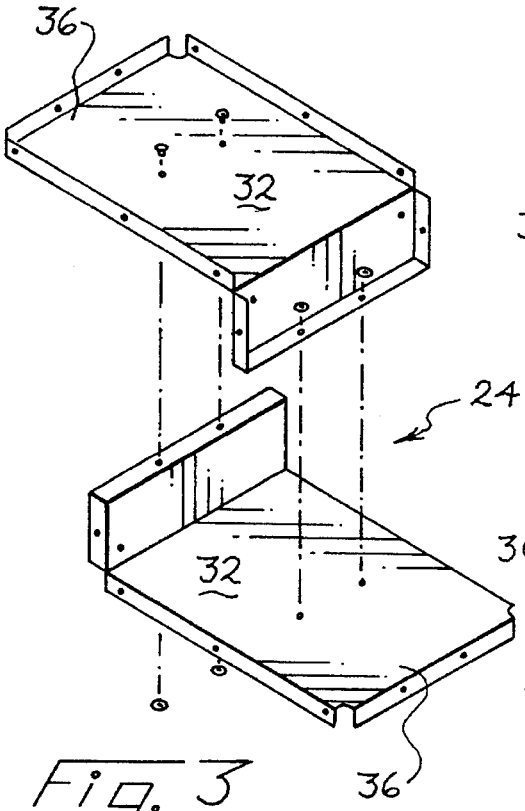
FIG. 3 is an exploded perspective view of an energy absorbing element from a forward bay of the crash attenuator of FIG. 2.
Figure 4:
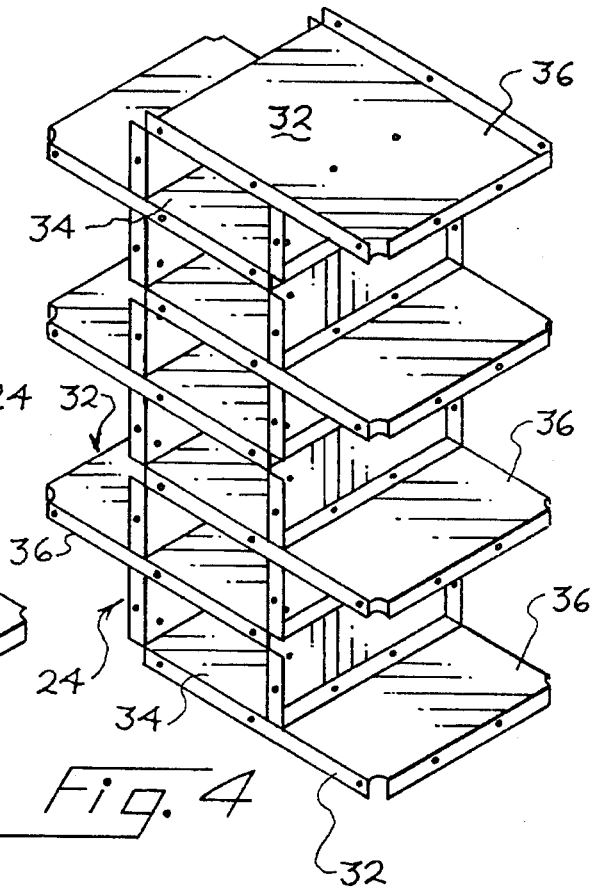
FIG. 4 is a perspective view showing the arrangement of six of the energy absorbing elements of FIG. 3 in one of the forward bays of the crash attenuator of FIG. 2.

As best shown in FIGS. 3 and 4, the energy-absorbing elements 24 are formed of two separately formed folded planar components 32. The folded planar components 32 are L-shaped in configuration, and in this embodiment are riveted together such that two folded components 32 cooperate to form a tubular column 34. The components 32 define panels 36 that extend outwardly from the tubular column 34. As shown in FIG. 4, six of the energy-absorbing elements 24 are arranged adjacent one another, with the tubular columns 34 arranged in a single row. The assembled energy-absorbing elements. 24 are secured between adjacent diaphragms 14 (FIG. 2), as for example by rivets and structural adhesives. Note that the panels 36 extending outwardly from the tubular columns 34 support the edge portions of the diaphragms 14 adjacent the forward bays 28. The energy absorbing elements 24 are generally similar to those shown in U.S. Pat. No. 4,711,481 (Krage).

Figure 5:
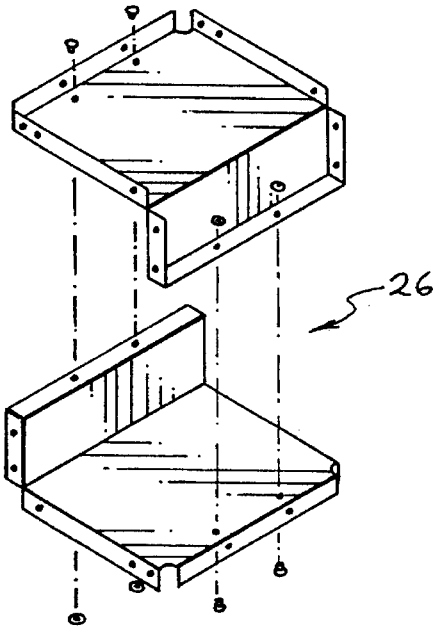
FIG. 5 is an exploded perspective view of an energy absorbing element from a rearward bay of the crash attenuator of FIG. 2.
Figure 6:
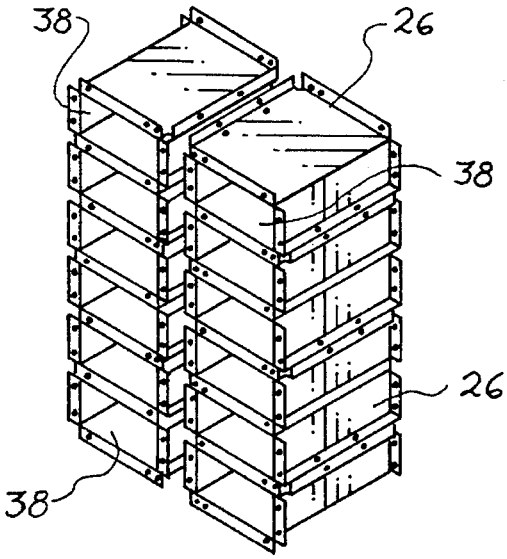
FIG. 6 is a perspective view showing the arrangement of twelve of the energy absorbing elements of FIG. 5 in one of the rearward bays of the crash attenuator of FIG. 2.

As shown in FIGS. 5 and 6, the rearward bays utilize energy-absorbing elements 26 that are in many ways similar to the energy absorbing-elements 24, but that lack the panels 36. Because the panels 36 are missing, the tubular columns 38 of the energy-absorbing elements 26 can be packed together more closely in two or more rows. In this embodiment there are twelve energy-absorbing elements 26 in each of the rearward bays 30, providing substantially increased rigidity to the rearward bays 30 as compared to the forward bays 28.

The rearward end of the crash attenuator 10 is reinforced with an attachment structure 22. As best shown in FIG. 7, the attachment structure 22 includes a number of fasteners such as studs 40 extending rearwardly. Each of the studs 40 is held in a fixed position on the attachment structure 22 by a stud holder 42. The attachment structure 22 is rigidly secured adjacent the rearward most one of the rearward bays 30 (FIG. 2).

As best shown in FIGS. 8–10, the energy-absorbing portion is mounted to a mounting portion 44. The mounting portion is secured to the studs 40 of FIG. 7 (which are received in respective openings 45), and the mounting portion 44 rigidly supports two first mounting tubes 46 in place. In this embodiment, the mounting tubes 46 are oriented parallel to one another, and they are vertically disposed when the crash attenuator 10 is in the operational position. The mounting portion 44 also includes upper and lower plates 48, 49 that define respective pin openings 50, 51, each aligned with a respective one of the first mounting tubes 46. As explained below, the mounting portion 44 is used to mount the crash attenuator 10 quickly and easily to the end E of the barrier B (FIG. 1).

Figure 11:
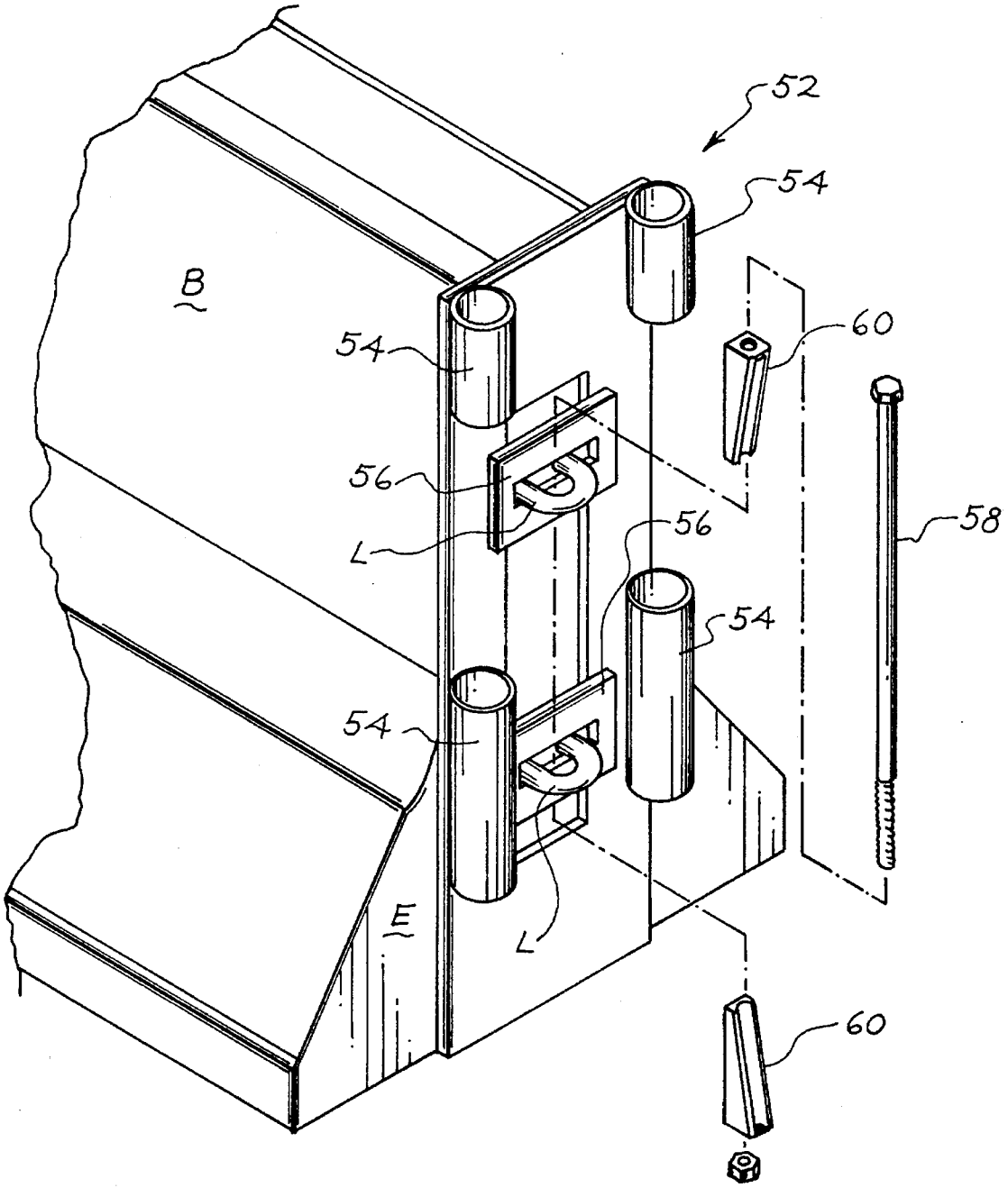
FIG. 11 is an exploded perspective view of a mounting bracket secured to the barrier of FIG. 1.

As best shown in FIG. 11, the end E of the barrier B includes two conventional end loops L. The end loops L are typically used in securing adjacent barriers together, but here they are used to provide an efficient means for adapting the barrier B to receive the crash attenuator 10. As shown in FIG. 11, a mounting bracket 52 is releasably mounted to end E of the barrier B. This mounting bracket 52 includes at least two second mounting tubes 54. In this embodiment, four second mounting tubes 54 are provided, arranged as shown in FIG. 11. The two upper second mounting tubes 54 are arranged to be co-linear with the respective ones of the two lower second mounting tubes 54, and the separation between the upper and lower second mounting tubes 54 is sufficient to receive the first mounting tubes 46 therebetween. The bracket also includes two aperture defining plates 56, each positioned to receive a respective one of the end loops L.

Figure 12:
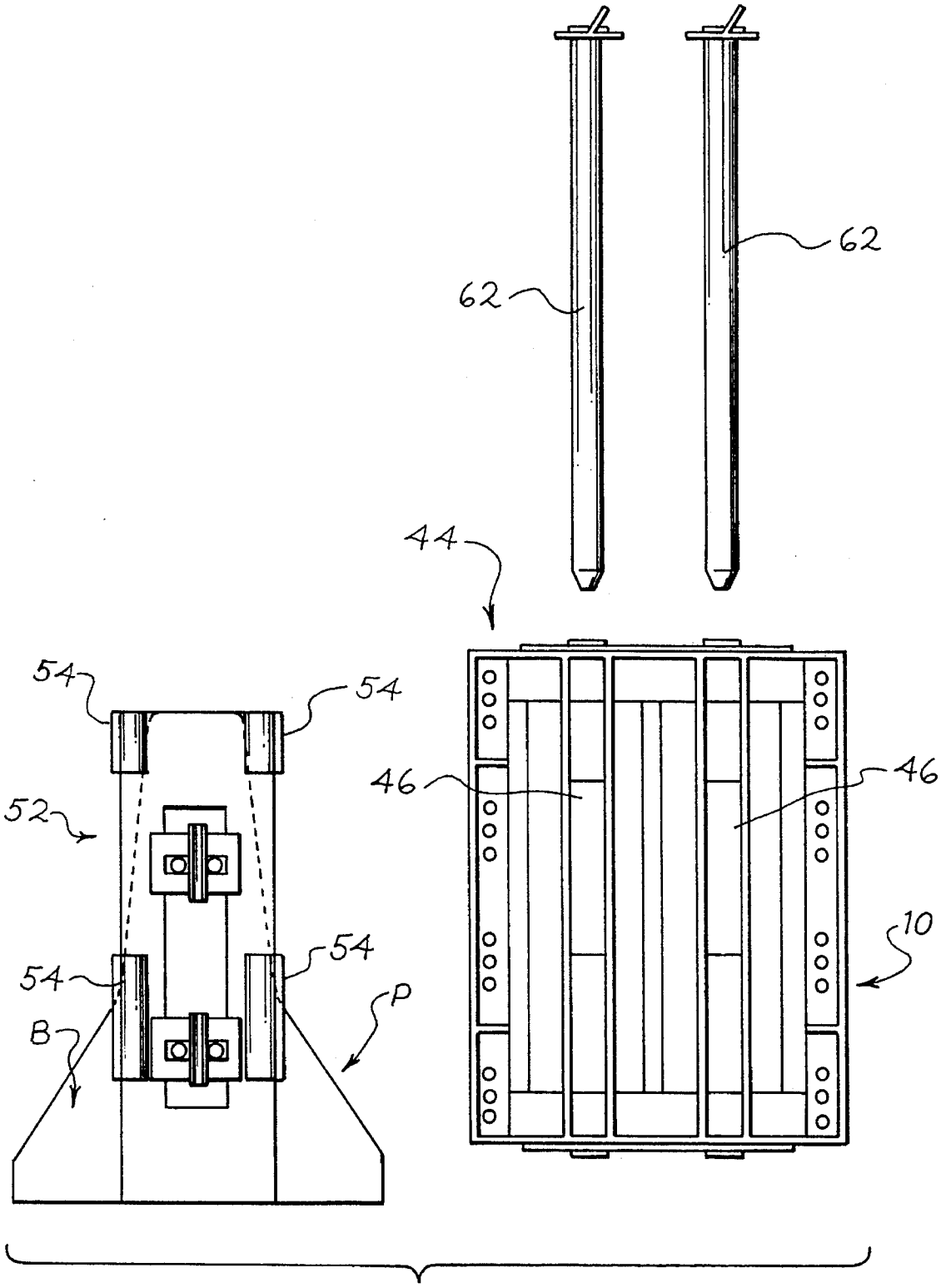
FIG. 12 is an elevational view showing the cooperation between the mounting bracket of FIG. 11 and the mounting portion of FIGS. 8–10.

The mounting bracket 52 is rigidly secured to the end E of the barrier B by a fastener 58 and wedges 60. The wedges 60 are inserted into the end loops L so as to bear between the end loops L and the aperture defining plates 56. The fastener 58 then forces the wedges 60 toward one another, thereby rigidly holding the mounting bracket 52 against the end E of the barrier B. As shown in FIG. 12, two pins 62 are provided, configured to fit within the aligned first and second mounting tubes 46, 54 and the openings 50, 51.

Figure 13:
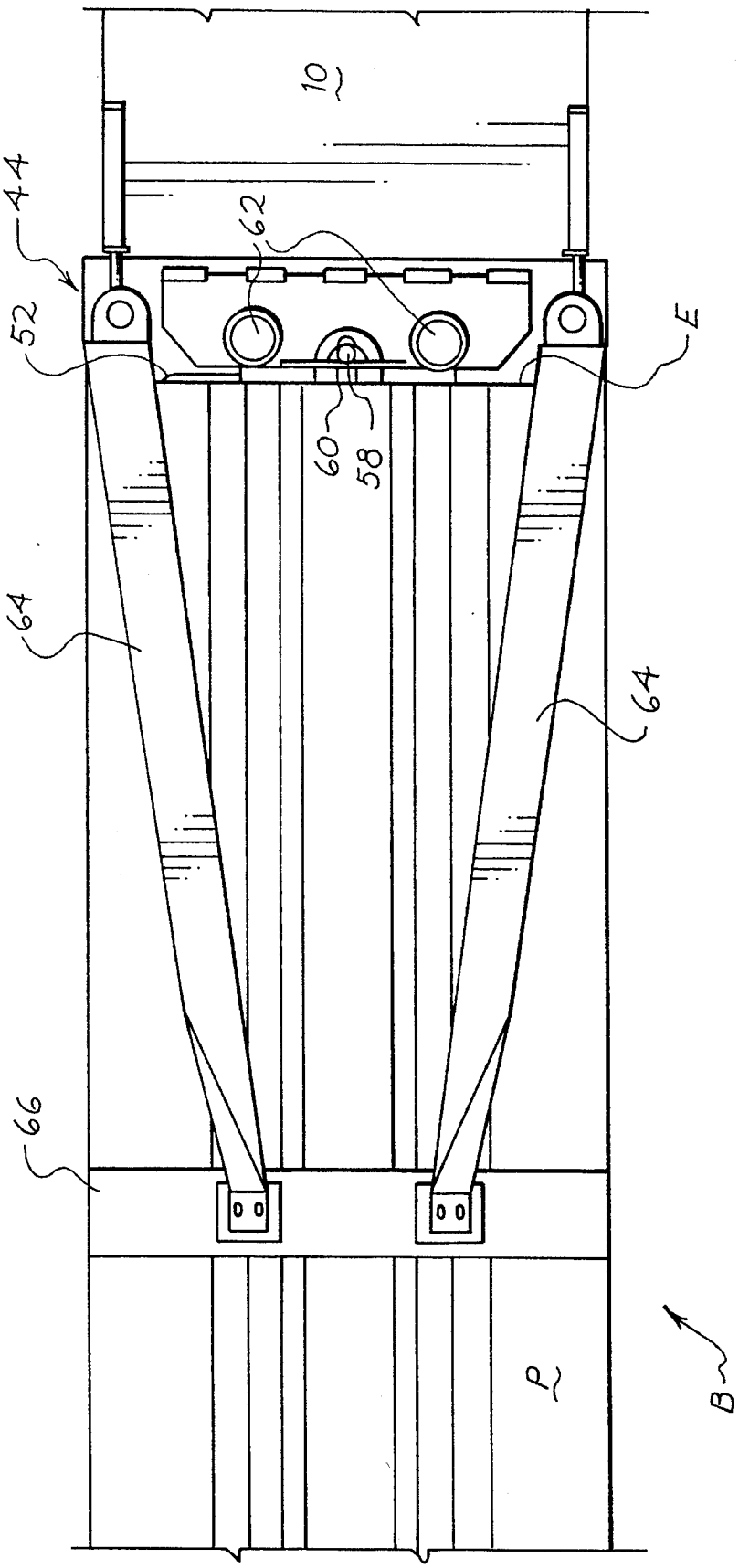
FIG. 13 is a top plan view of the crash attenuator of FIG. 1.

The barrier B defines a profile P which differs substantially from that of the crash attenuator 10 (FIG. 13). Normally this presents no problem, because impacting vehicles typically strike the forward portion of the crash attenuator 10. However, in the event a vehicle travels along the barrier B toward the crash attenuator 10, such a vehicle might snag on the crash attenuator 10. In order to reduce the likelihood of such an event, the crash attenuator 10 is provided with two vehicle deflecting members 64. These vehicle deflecting members (so-called wrong way panels) are rigidly secured to the mounting portion 44 at one end and to a strap 66 surrounding the barrier B at the other end. The vehicle deflecting members 64 provide a transition between the profile P of the barrier B and the crash attenuator 10.

When it is desired to install the crash attenuator 10 on the barrier B, the mounting bracket 52 is first installed on the end E of the barrier B using the fastener 58 and the wedges 60. This can be done off-site in many cases. If performed adjacent a roadway, it can be done quickly and simply by one person. If desired, the strap 66 and the vehicle deflecting members 64 are installed on the barrier B. Installation of the crash attenuator 10 is completed simply by aligning the first mounting tubes 46 with the second mounting tubes 54 and installing the pins 62. The vehicle deflecting members 64, if desired, can then readily be secured to the mounting portion 44. The crash attenuator 10 is light in weight, and it typically can be lifted into position without the requirement of a forklift or other similar equipment. The entire installation or removal can be done quickly and simply by a small number of people without heavy equipment.

Figure 14:
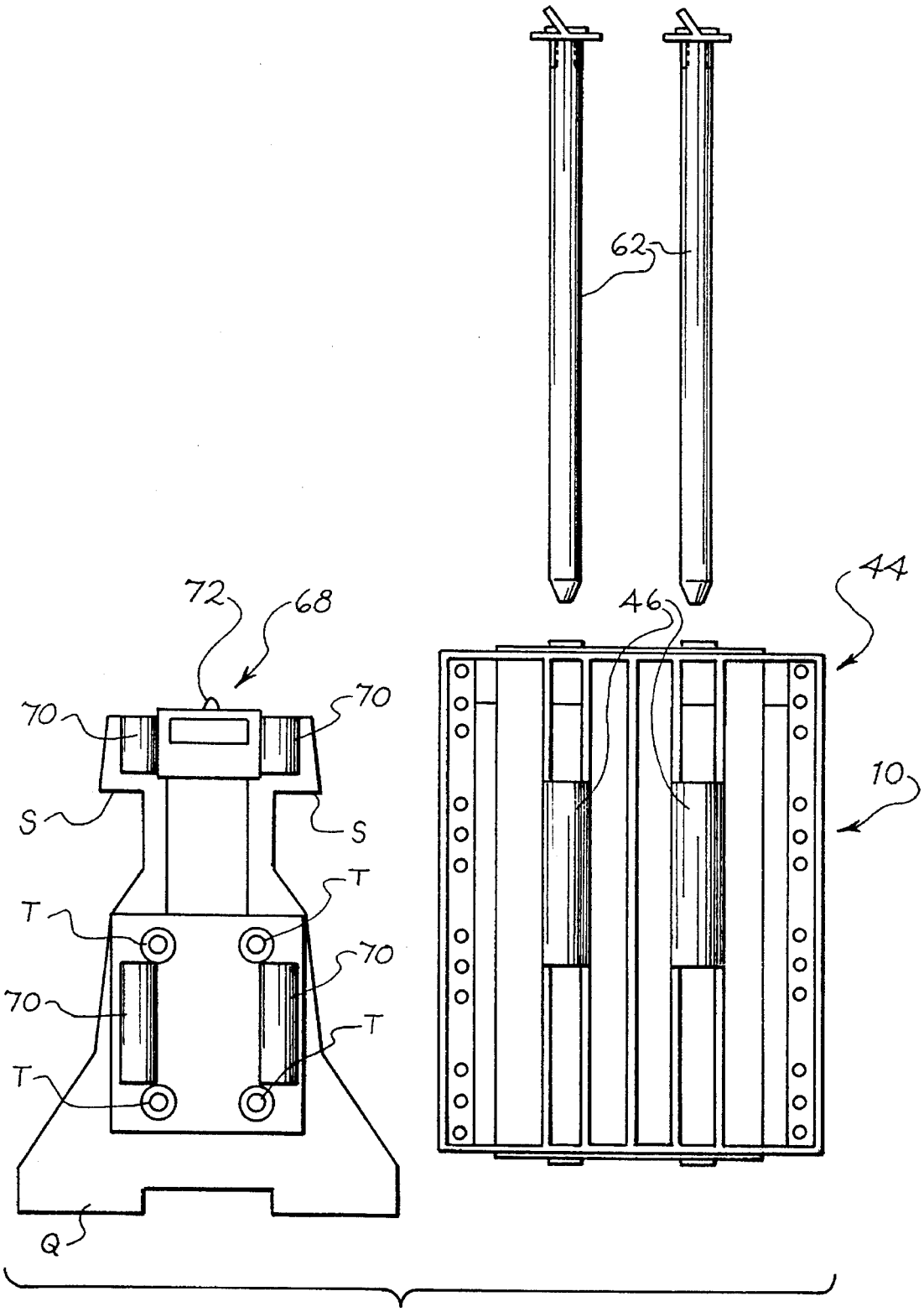
FIG. 14 is an elevational view of the crash attenuator of FIG. 1 positioned for mounting to an alternate barrier.

The crash attenuator 10 described above can also be used with other types of barriers, such as a quick-change barrier Q (FIG. 14). The quick-change barrier Q has a barrier profile with a T-shaped upper section defining first lifting surfaces S. Such a quick-change barrier Q can be quickly moved from one location to another, as described in U.S. Pat. No. 4,500,225 (Quittner).

One conventional form of the quick-change barrier Q includes hinges which are held in place by threaded fasteners T. In order to mount the crash attenuator 10 to the quick-change barrier Q, a modified mounting bracket 68 is provided. This modified mounting bracket 68 includes upper and lower second mounting tubes 70, and is secured in place on the quick-change barrier Q with the threaded fasteners T and additional fasteners 72 at the top of the quick-change barrier Q. Installation and removal of the crash attenuator 10 on the quick-change barrier Q is quite similar to the corresponding operations on the barrier B described above.

Figure 18:
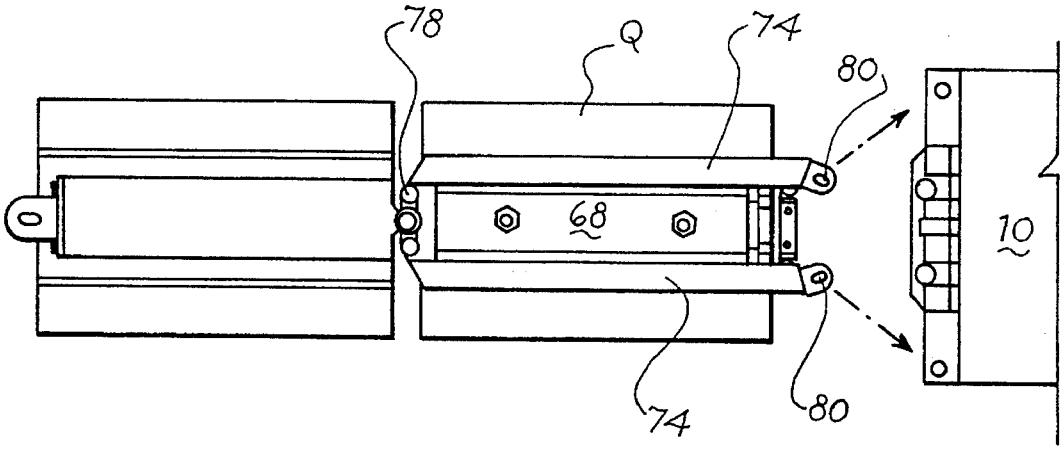
FIGS. 18, 19 and 20 are top plan views showing the crash attenuator of FIG. 1 in successive stages of installation on the barrier of FIG. 14.
Figure 19:
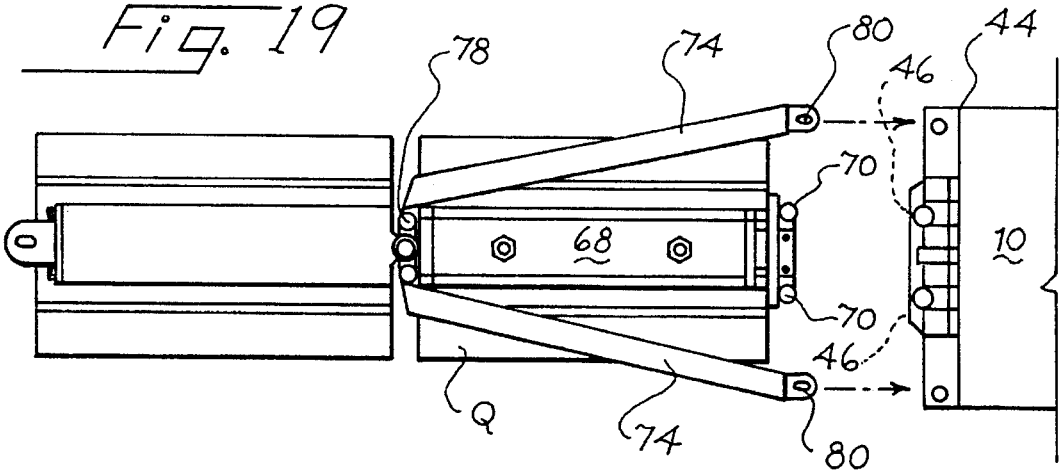
Figure 20:
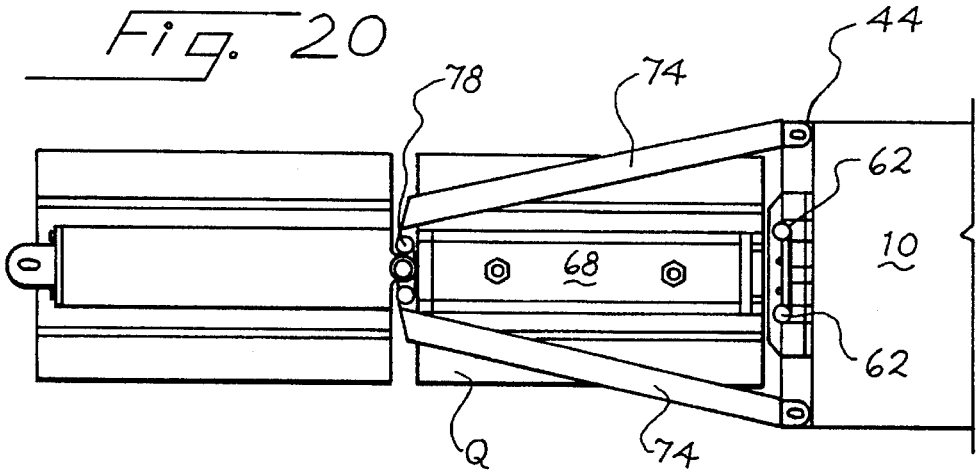

As shown in FIGS. 15–17, vehicle deflecting members 74 can be provided for the quick-change barrier Q. These members 74 have a profile which matches the T-shaped profile of the quick-change barrier Q and includes a second lifting surface 76 shaped to lie alongside and under the first lifting surface of the quick-change barrier Q. The vehicle deflecting members 74 include hinges 78 at the rearward end and apertures 80 at the forward end. As shown in FIG. 18, the vehicle deflecting members 74 can be stored in a retracted position alongside the quick-change barrier Q. In this position, the vehicle deflecting members 74 allow conventional equipment to lift the quick-change barrier Q by rollers that in this case bear on the second lifting surfaces of the vehicle deflecting members 74. In order to mount the crash attenuator 10 on the quick-change barrier Q, the vehicle deflecting members 74 (if present) are opened to the extended position of FIG. 19. Then the crash attenuator 10 is positioned with the first mounting tubes 46 aligned between the upper and lower second mounting tubes 70, and pins 62 are used to rigidly secure the crash attenuator 10 to the quick-change barrier Q (FIG. 17). Additional fasteners are then used to secure the forward ends of the vehicle deflecting members 74 to the mounting portion 44.

Simply by way of example, the following details of construction are provided in order to clarify a presently preferred embodiment of this invention. The crash attenuator 10 can be designed to provide suitable decelerating forces for both 50 kph and 70 kph applications. The energy-absorbing portion 12 can measure 22.5 inches in width by 32 inches in height. The length of the crash attenuator 10 will vary with the application. For example, with a 70 kph application, the length can be 116 inches (weight 287 pounds). The 50 kph version can have a length of 69 inches and a weight of 177 pounds. Due to their light weight, either version can easily be moved without the use of a forklift or other mechanical lifting device. These crash attenuators have been designed for ease of use and can be attached to barriers as described above using simple hand tools in a matter of minutes without drilling into the concrete of the barriers.

The 70 kph version includes ten bays, including six forward bays 28 and four rearward bays 30. The 50 kph version can have six bays, including four forward bays 28 and two rearward bays 30.

When the crash attenuator 10 is subjected to an impact, the kinetic energy of motion of the impacting vehicle is dissipated by crumpling or folding the energy-absorbing elements 24, 26. As folds develop in the energy-absorbing elements 24, 26 the material experiences plastic deformation, which converts the kinetic energy of the impacting vehicle into heat. This process continues until the energy-absorbing elements 24, 26 are all strained to failure or fracture, or all of the kinetic energy of the impacting vehicle is dissipated.

A lesser, though important, attenuation of energy is achieved through the compression of air trapped within the energy-absorbing elements 24, 26 as they are crushed. The trapped air within the tubular columns 34, 38 cannot escape quickly as it is being compressed by the impacting vehicle. This results in a compression of the air and further conversion of kinetic energy into heat.

The attenuation characteristics of the crash attenuator 10 can be adapted for the application by adjusting the type of material from which the energy-absorbing elements 24, 26 are made, the placement and number of energy-absorbing elements 24, 26 within the attenuator 10, and the thickness of the material used to form the energy-absorbing elements 24, 26.

Of course, materials and fabrication techniques can be selected as appropriate for the particular application. The following materials have been found suitable, though they are, of course, not limiting. All of the above described portions of the crash attenuator 10 except for the attachment structure 22 and the mounting portion 44 can be formed of a sheet metal such as 5052-H32 aluminum alloy. The panels 16, 18, 20 can, for example, be formed of this material in 0.063 inch thickness, the energy absorbing elements 24 and the diaphragms 14 can be formed of this material in 0.032 inch thickness, and the energy-absorbing elements 26 can be formed of this material in a thickness of 0.032 or 0.040 inch.

It is presently preferred to use a sheet thickness of 0.040 inches for the energy absorbing-elements 26 of the rearward bays 30 of the 70 kph version of the attenuator 10, and a sheet thickness of 0.032 inches for the energy-absorbing elements 26 of the rearward bays 30 of the 50 kph version. The attachment structure can be made of 14 gauge sheet steel (ASTM A-570, grade 30). The vehicle deflecting panels 64 and the mounting portion 44 can be made from suitable steel alloys. If desired, casters can be mounted on the lower surface of the attenuator 10 to facilitate movement.

Of course, it should be understood that a wide range of changes and modifications can be made to the preferred embodiments described above. Though it is preferred to use the features of the invention together as described above, they can of course be used separately. The materials, proportions and arrangements described above can all be adapted as desired for the particular application. It is therefore intended that the foregoing detailed description be regarded as illustrative rather than limiting, and that it be understood that it is the following claims, including all equivalents, which are intended to define the scope of this invention.

We claim:

1. In a highway barrier comprising a crash attenuator secured to one end of the barrier, said crash attenuator being wider than the barrier so as to extend laterally beyond a profile defined by the barrier, the improvement comprising:

at least one vehicle-deflecting member hinged to the barrier to pivot between an extended position, in which the vehicle-deflecting member is secured between the barrier and the crash attenuator to provide a transition between the profile defined by the barrier and the crash attenuator, and a retracted position, in which the vehicle-deflecting member is stored alongside the barrier when the crash attenuator is removed from the barrier.

2. The invention of claim 1 wherein the barrier comprises a T-shaped upper portion comprising a first lifting surface extending along the barrier, and wherein the vehicle-deflecting member comprises a second lifting surface shaped to lie closely adjacent to the first lifting surface when the vehicle-deflecting member is in the retracted position.

* * * * *